US007404611B1

(12) United States Patent
Que

(10) Patent No.: US 7,404,611 B1
(45) Date of Patent: Jul. 29, 2008

(54) PIN AND TORSION SPRING LOCK FOR A DRAWER SLIDE

(75) Inventor: Jianzhang Que, Singapore (SG)

(73) Assignee: Central Industrial Supply Company, Fort Worth, TX (US)

( * ) Notice: Subject to any disclaimer, the term of this patent is extended or adjusted under 35 U.S.C. 154(b) by 157 days.

(21) Appl. No.: 10/887,567

(22) Filed: Jul. 9, 2004

Related U.S. Application Data

(60) Provisional application No. 60/485,680, filed on Jul. 9, 2003.

(51) Int. Cl.
*A47B 88/00* (2006.01)

(52) U.S. Cl. ..... 312/334.46; 312/333

(58) Field of Classification Search ..... 312/332.1, 312/333, 334.1, 334.7, 334.8, 334.9, 334.11, 312/334.44–334.47, 319.1, 334.5, 334.4; 384/21

See application file for complete search history.

(56) References Cited

U.S. PATENT DOCUMENTS 2,739,027 A * 3/1956 Gussack ..... 312/333
3,801,166 A * 4/1974 York ..... 384/18
5,551,775 A * 9/1996 Parvin ..... 312/334.11
5,757,109 A * 5/1998 Parvin ..... 312/334.11
6,375,290 B1 * 4/2002 Lin et al. ..... 312/334.46
6,464,311 B2 * 10/2002 Liang et al. ..... 312/334.46
6,851,774 B2 * 2/2005 Chen et al. ..... 312/334.47
6,945,619 B1 * 9/2005 Chen et al. ..... 312/334.47
6,962,397 B2 * 11/2005 Dobler et al. ..... 312/333
6,979,067 B2 * 12/2005 Yang ..... 312/334.46
7,029,080 B2 4/2006 Barry et al.

* cited by examiner

*Primary Examiner*—Janet M Wilkens
(74) *Attorney, Agent, or Firm*—Mark W. Handley

(57) ABSTRACT

A drawer slide has a pin and torsion spring lock (28) for securing an intermediate slide member (16) relative to a cabinet member (18). A lock pin (154) has a head (180) and a shank (178). A groove (182) is formed into the shank (178). A torsion spring (156) is secured to the intermediate slide member (14) and engages the groove (182) to urge the lock pin (154) into a first position within a slot (158) formed in the intermediate slide member (16). The head (180) of the lock pin (154) extends on an opposite side of the intermediate slide member (16) from the torsion spring (156). Two stops (162, 164) are disposed on the cabinet slide member (18) for engaging with the head (180) of the lock pin (154). A release member (172) is embossed in the web portion (44) of the chassis member (14).

20 Claims, 13 Drawing Sheets

PIN AND TORSION SPRING LOCK FOR A DRAWER SLIDE

CROSS-REFERENCE TO RELATED APPLICATION

The present application is related to U.S. Provisional Patent Application Ser. No. 60/485,680, filed Jul. 9, 2003, and invented by Wenming Yang, Jianzhang Que, and Alfred E. Barry, Jr., and assigned to Central Industrial Supply Company, Inc., of Grand Prairie, Tex., the assignee of the present application.

TECHNICAL FIELD OF THE INVENTION

The present invention relates in general to drawer slides, and in particular to latches for selective securing together various members of drawer slides.

BACKGROUND OF THE INVENTION

Prior art drawer slides have been used for moveably securing a chassis, such as a drawer, to various types of cabinets, such as equipment racks and the like. The drawer slides have been provided by elongate members having formed edges which are nested together in sliding engagement for telescopically moving between extended and retracted positions. The drawer slides are typically mounted within a cabinet in a spaced apart alignment for securing to opposites sides of a chassis, such that the chassis is moveable outward of the cabinet in a cantilevered support arrangement. Various drawer slide locks have been provided for securing the drawer slides in the extended positions, both to prevent the chassis from being pushed back into the cabinet and to prevent inadvertent disassembly of the drawer slides. Some prior art drawer slides have included locks which are released by pushing a user's finger directly against a locking member to release the slides for moving a chassis move back into a cabinet, and to release the slides to allow the chassis to be disassembled from the cabinet. Other prior art drawer slide locks are released by moving slide members or release members into a lock member, such that the lock member is displaced to allow the drawer slides to be moved from extended positions.

SUMMARY OF THE INVENTION

A drawer slide has features which include a push-pull release for a front release for a front lock, a gear and pawl lock for use with a front release, a rear lock provided by a pin with torsion spring, and a guide bushing with bearing retainer lock. The drawer slide has a chassis member, an intermediate member and a cabinet member which are slidably secured together in a telescopic arrangement. A bearing retainer is moveably disposed in the intermediate member. A guide bushing is disposed in an outward end of the intermediate slide member. The guide bushing preferably has a lock arm which extends rearwardly from the guide bushing. The lock arm has a lock tab extending from a terminal end thereof, and a cam surface disposed in an intermediate portion of the lock arm. A J-slot is preferably formed into a forward end of the bearing retainer to provide a notch which is disposed for engaging with the lock tab of the lock arm when the bearing retainer is disposed in a forward position relative to the intermediate member. A release member is embossed in a web portion of the chassis member. The release member is disposed for engaging the cam surface of the lock arm to urge the lock tab from engaging within the J-slot of the bearing retainer, releasing the bearing retainer for moving from the forward position.

The drawer slide has a push-pull release handle secured to the chassis member for operating a front release for a front lock. The front release includes a release member which is slidably secured to the chassis member and which extends to the front lock from a position which is distally disposed from the front lock. The release member has a lever aperture disposed therein. The push-pull handle is slidably secured to the forward end of the chassis member. The handle has an oblong-shaped aperture formed in a rearward portion of the handle. A reversing lever has first and second ends disposed on opposite sides of the reversing lever, and two spaced apart tabs. The first tab is slidably secured in the oblong-shaped aperture of the push-pull handle and the second tab is pivotally secured to the chassis member. The reversing lever is disposed in the lever aperture of the release member. Moving the push-pull handle in a forward direction moves the first end of said reversing lever against a forward end of lever aperture to pull the release member in a forward direction, away from the front lock. Moving said handle in a rearward direction, opposite the forward direction, moves the second end of the reversing lever against the forward end of the lever aperture of the release member, to again pull the release member in the forward direction and away from the front lock to release the front lock from securing the chassis member in an extended position relative to the intermediate member.

The drawer slide has a gear and pawl lock which is preferably used for the front lock to releasibly secure the chassis member in an extended position relative to the intermediate member. The gear and pawl lock includes a ratchet gear member which is rotatably secured to the chassis member. The ratchet gear member has notches which define cogs. A pawl member has a pawl tip and is moveably secured to the chassis member for engaging within the notches of the ratchet gear member. A bias means is also secured to the chassis member for urging the pawl tip into respective ones of the notches. The cogs and the pawl tip are shaped to define cam surfaces for rotation of the ratchet gear member in a first direction, pushing the pawl tip rearward and allowing rotation of the ratchet gear member in a first angular direction and preventing rotation of the ratchet gear member in a second direction. Two protuberances extend from the intermediate member in a spaced apart arrangement to define stops for engaging within the notches of the ratchet gear member, and preventing rotation of the ratchet gear member in a first angular direction. The release member is connected to the pawl tip, preferably with the pawl tip being defined by a rearward end of the release member. The release member is slidably secured to the chassis member for moving the pawl tip from engaging within the notches of the ratchet gear member, to allow the ratchet gear member to rotate in an opposite angular direction to the first angular direction and away from the two protuberances defining the two stops.

The drawer slide has a pin and torsion spring lock used for locking the intermediate member in an extended position relative to the cabinet member. A slot is formed into the web portion of the intermediate slide member with a length extending in a direction which is transverse to the longitudinal axis of the drawer slide. A pin has a head and a shank. The shank of the pin has a notch provided by an annular-shaped groove. A torsion spring is secured to the intermediate member and engages within the notch in the shank of the pin to urge the pin into a first position within the slot. The head of the pin extends on an opposite side of the intermediate member from the torsion spring. A stop is disposed on the third slide member, aligned for engaging the head of the pin as the intermediate member is moved within the cabinet member. A release member is embossed in the web portion of the chassis member for moving with the chassis member and engaging the shank of the pin to move the pin to a second position within the slot, in which the head of said pin is disposed aside of the stop to release the intermediate member for moving relative to the cabinet member.

DESCRIPTION OF THE DRAWINGS

For a more complete understanding of the present invention and the advantages thereof, reference is now made to the following description taken in conjunction with the accompanying Drawings in which

FIG. 1 is a perspective view of a first side of a drawer slide;

FIG. 2 is a perspective view of a second side of the drawer slide;

FIG. 3 is an exploded view of the drawer slide, which is shown in perspective;

FIG. 4 is a perspective view of a reversing lever for the push-pull handle of a front release;

FIG. 5 is a partial perspective view of the push-pull handle of the front release, shown in a neutral position;

FIG. 6 is a partial perspective view of the push-pull handle of the front release, shown after being moved to an outward position;

FIG. 7 is a partial perspective view of the push-pull handle of the front release, shown after being moved to an inward position;

FIG. 8 is partial perspective view of a first side of a ratchet gear member of a front lock for the drawer slide;

FIG. 9 is a partial perspective view of a second side of the ratchet gear of the front lock;

FIG. 10 is a partial perspective view of the front lock securing the chassis member in an extended position relative to an intermediate member;

FIG. 11 is a partial perspective view of the front lock after being released from securing the chassis member in an extended position relative to the intermediate member;

FIG. 12 is partial perspective view of a first side of a pin and torsion spring lock providing a rear lock for the drawer slide;

FIG. 13 is a perspective view of a pin for use with the rear lock;

FIG. 14 is a perspective view of a torsion spring for use with the rear lock;

FIG. 15 is a partial perspective view of the pin and torsion spring lock providing a rear lock for the drawer slide;

FIG. 16 is a partial perspective view of an emboss on a rearward end of the chassis member having a profile for releasing the pin and torsion spring lock of the drawer slide;

FIG. 17 is partial section view of an outward end of an intermediate member of the drawer slide, showing a bearing retainer fastening means for the drawer slide;

FIG. 18 is partial section view of an outward end of an alternative embodiment of an intermediate member of the drawer slide, showing an alternative bearing retainer fastening means for the drawer slide;

FIG. 19 is a partial section view of an outward end of an intermediate member of the drawer slide, having a guide bushing which includes a bearing retainer lock according to a preferred embodiment of the drawer slide;

FIG. 20 is a partial exploded view of the intermediate member having the guide bushing with the bearing retainer lock;

FIG. 21 is a partial exploded view of the intermediate member having the guide bushing with the bearing retainer lock;

FIG. 22 is a top view of the guide bushing having the bearing retainer lock;

FIG. 23 is sectional view of the intermediate member of FIG. 21, taken along Section Line 23-23;

FIG. 24 is a perspective view of a portion of a chassis member having an emboss for releasing the bearing retainer lock of the guide bushing; and FIG. 25 is a partial side elevation view of the drawer slide, showing operation of the guide bushing having the bearing retainer lock.

DETAILED DESCRIPTION OF THE INVENTION

Figure 1:
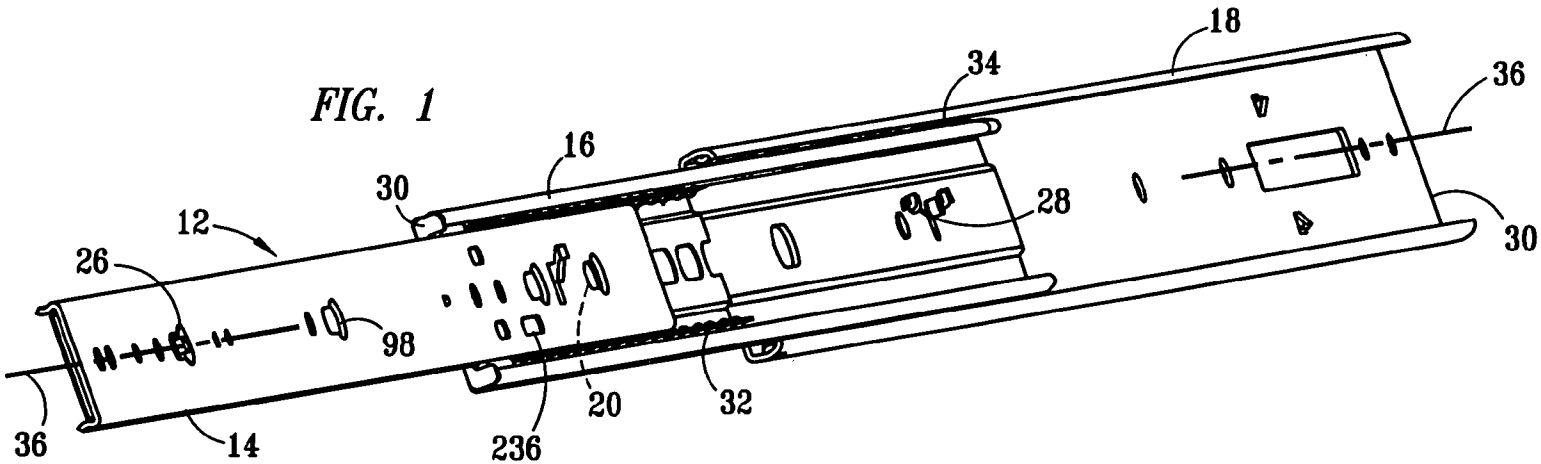
FIGS. 1 through 25 show various aspects for a guide bushing having ball bearing retainer lock for a drawer slide devices made according to the present invention, as set forth below.
Figure 2:
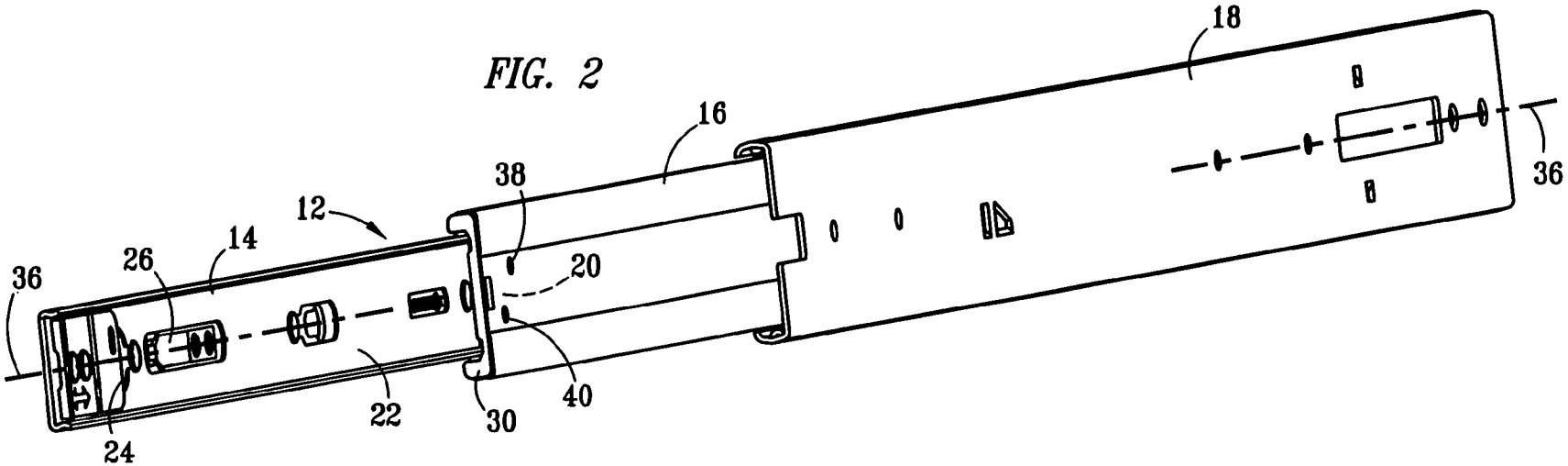

FIGS. 1 and 2 are perspective views of opposite sides of a drawer slide 12. The drawer slide 12 has a chassis member 14, an intermediate member 16 and a cabinet member 18 which are elongate members having edge portions that are formed for inter-fitting such that the drawer slide 12 is telescopically extensible along a longitudinal axis 36. The edge portions of the members 14, 16 and 18 are preferably formed to provide the respective elongate members with U-shaped cross-sections, to provide the members 14, 16 and 18 with channel forms. In the preferred embodiment, the drawer slide 12 is a bearing type drawer slide such that the edge portions of the members 14, 16 and 18 are formed to provide bearing races. In other embodiments of the present invention, features of the drawer slide 12 may be used with friction type drawer slides and the edge portions of a chassis member corresponding to the chassis member 14 may be formed to extend in a plane, outward and away from a central longitudinal axis 36 of the corresponding chassis member, rather than being formed to turn back towards the central longitudinal axis 36. In such friction drawer slide type embodiments, the edges of chassis members will preferably be offset from a central portion of the chassis member to provide clearance between a chassis member and an intermediate member for components providing locks and fasteners.

The drawer slide 12 has a front lock 20 for releasibly securing the chassis member 14 in an extended position relative to the intermediate member 16. The front lock 20 is preferably provided by a gear and pawl, ratchet lock. A front release 22 with a push-pull handle 24 is provided for selectively latching and releasing the front lock 20. The push-pull handle 24 may be moved inward or outward along the longitudinal axis 36 of the drawer slide 12 to move the front release 22 to release the front lock 20. The drawer slide 12 further includes a chassis latch 26 for securing the chasses in the chassis member 14. A rear lock 28 secures the intermediate member 16 in an extended position relative to the cabinet member 18, until the chassis member 16 is moved from an extended position into a retracted position within the intermediate member 16. The rear lock 28 is preferably provided by a pin and torsion spring lock. A guide bushing 30 is secured in a forward end of the intermediate member 16, for guiding insertion of the chassis member 14 into the intermediate member 16. Bearing retainer 32 and two bearing retainers 34 secure ball bearings between edges of respective ones of the chassis member 14, the intermediate member 16 and the cabinet member 18. Two protuberances 38 and 40 are provided in a web portion 42 of an outward end of the intermediate member 16, preferably by embosses formed into a central web portion of the intermediate member 16. The emboss 38 preferably fits within a tapered slot 190 (shown in FIG. 3B) formed in outward end of the bearing retainer 32 for releasibly securing the outward end of the bearing retainer 32 in an outward end of the intermediate member 16 for receiving the chassis member 14.

Figure 3:
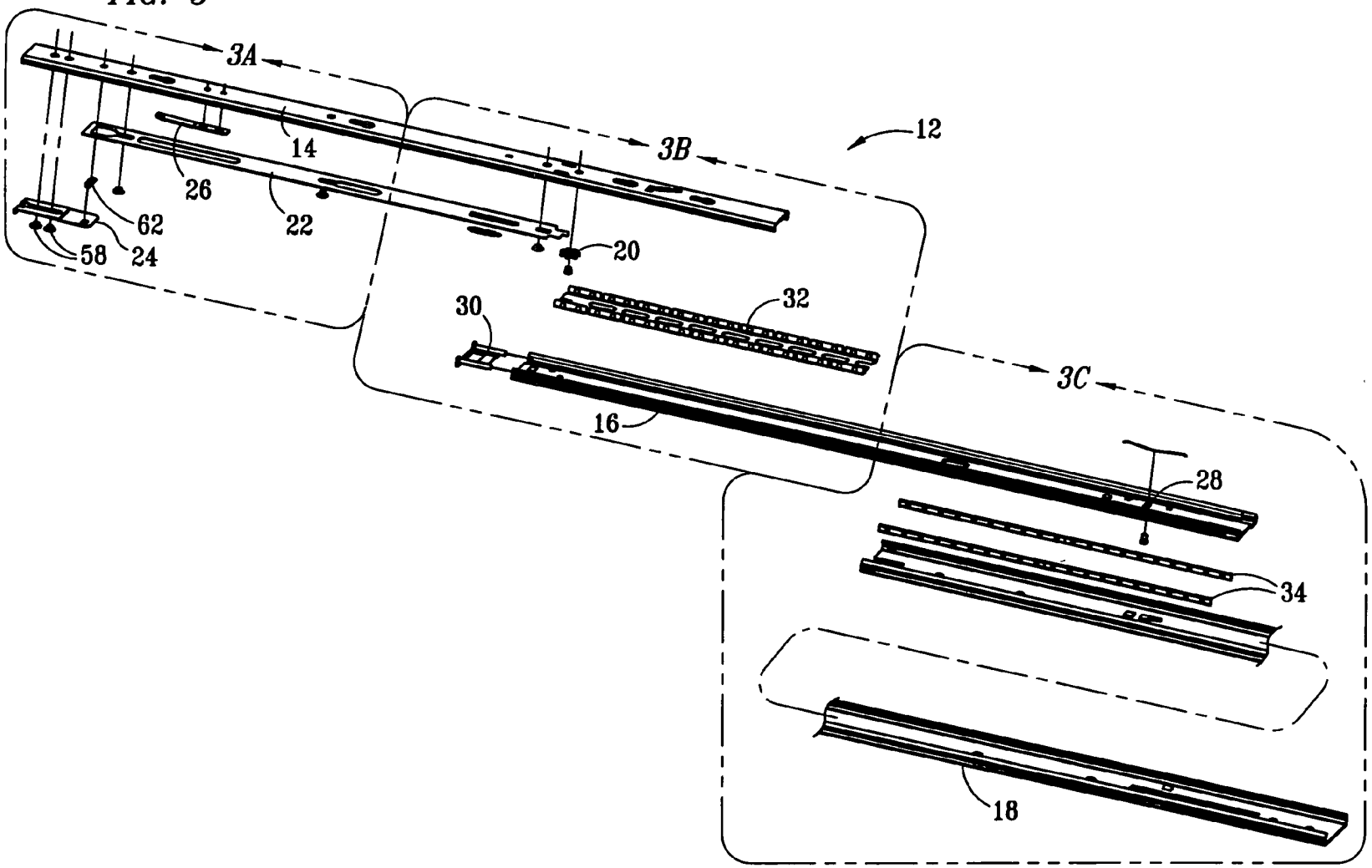
Figure 3A:
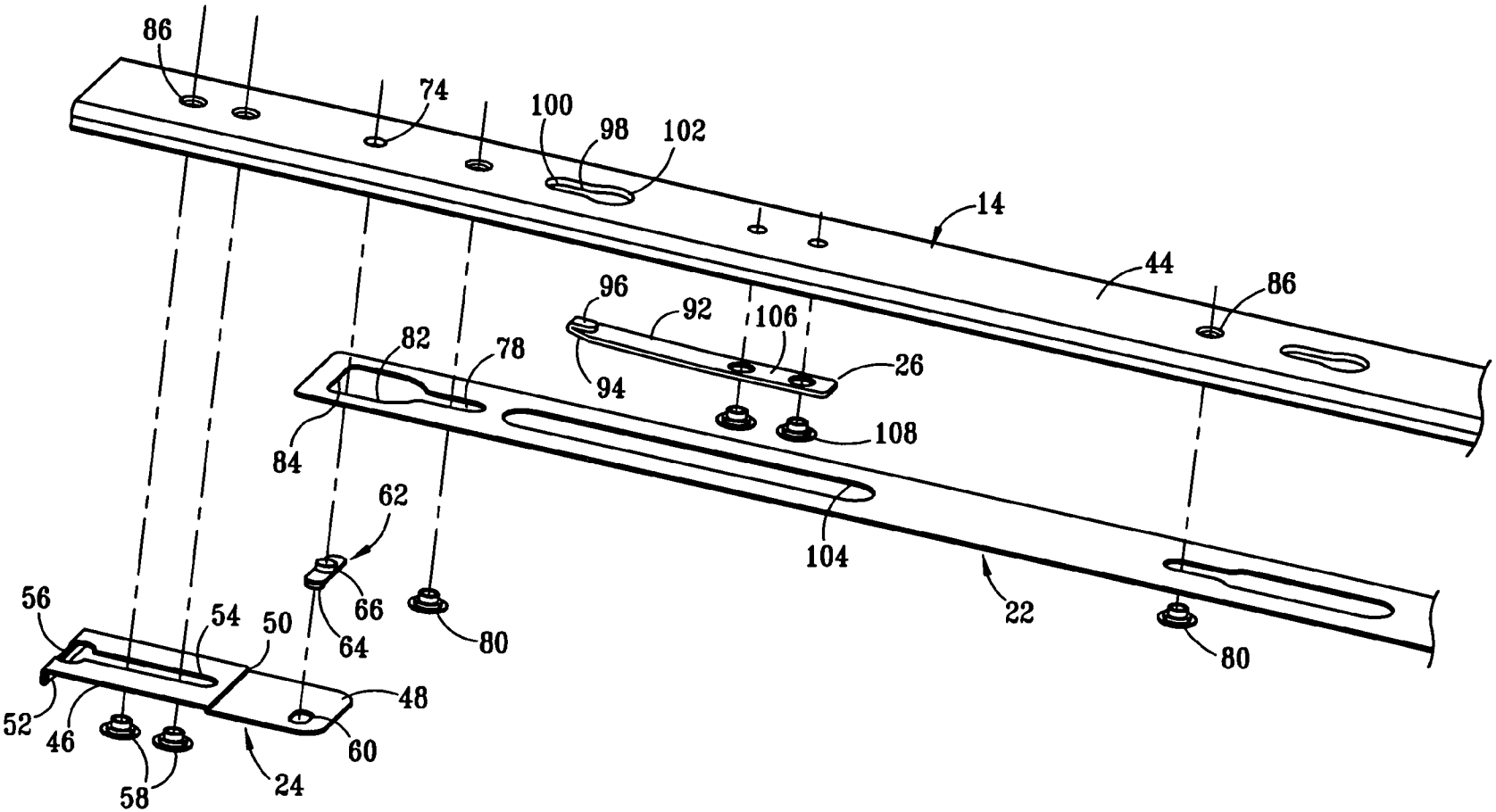
FIG. 3A is a partial exploded view of a forward portion of the drawer slide.
Figure 3B:
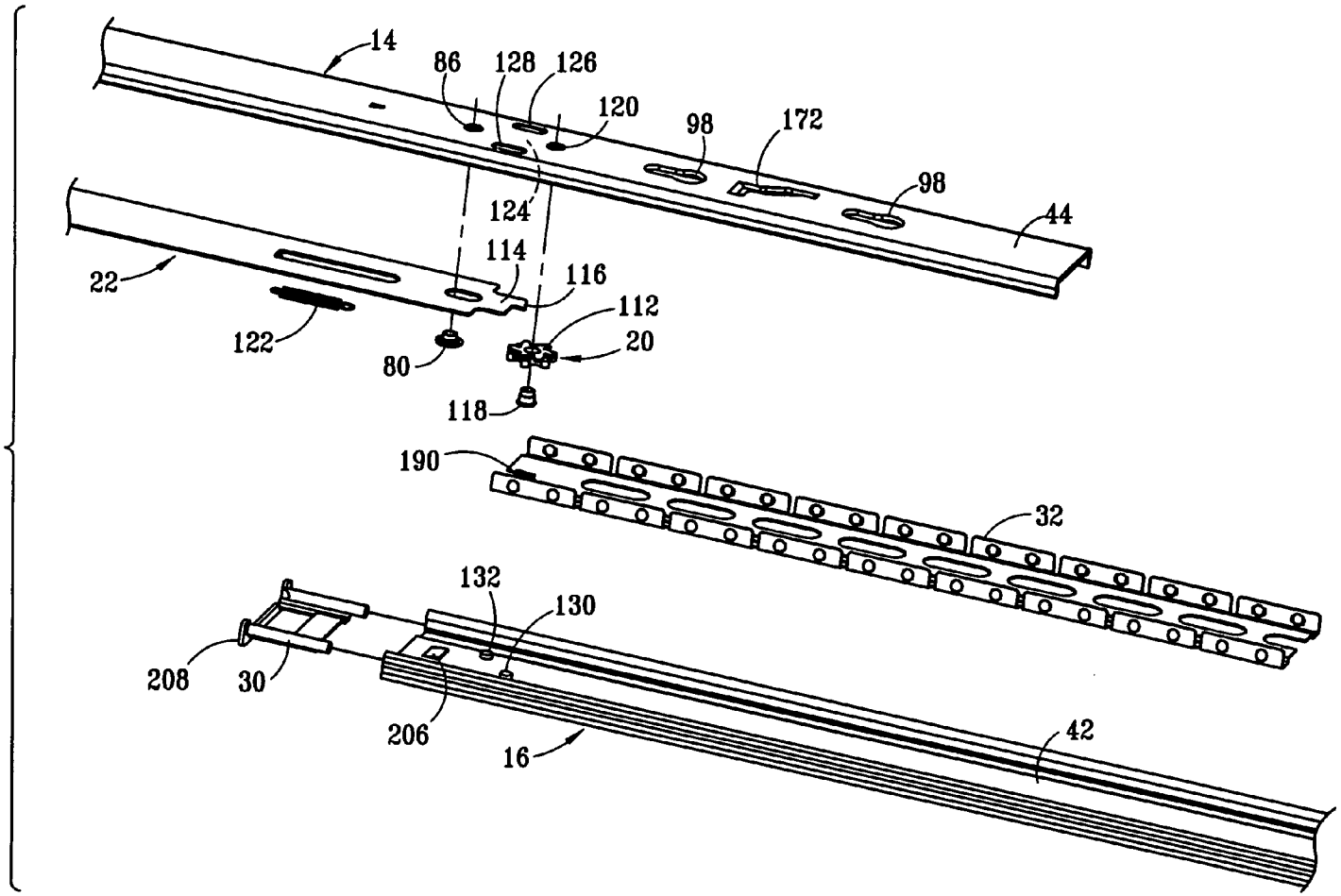
FIG. 3B is a partial, exploded view of an intermediate portion of the drawer slide.

FIGS. 3 and 3A through 3B are exploded, perspective views showing the features of the drawer slide 12 in more detail. The push-pull handle 24 has a first elongate portion 46 and a second elongate portion 48 which preferably extend in parallel planes, offset by a joggle 50. The first elongate portion 46 has a longitudinally extending slot 54 for slidably receiving the shanks of two fasteners 58. The two fasteners 58 are preferably provided by rivets which slidably secure the push-pull handle 24 to a web portion 44 of the intermediate member 14. An enlarged end 56 is provided for the slot 54, which is sized for passing the heads of the fasteners 58, such that the push-pull handle 24 may be removed from the chassis member 14 after being secured with the fasteners 58. The heads of the fasteners 58 are sized to be wider than the slot 54. An oblong-shaped aperture 68 is provided in the second portion 24 of the push-pull handle 24, preferably with a length which extends perpendicular to the longitudinal axis 36 of the push-pull handle 24 and the drawer slide 12, and transverse to the direction in which the push-pull handle 24 is moved relative to the chassis member 14 to release the front lock 20. The aperture 68 slidably receives a tab 64 of a reversing lever 62, with the tab 66 of the reversing lever 62 pivotally securing the reversing lever 62 within a lever mounting aperture 74 in the web portion 44 of the chassis member 14.

Figure 4:
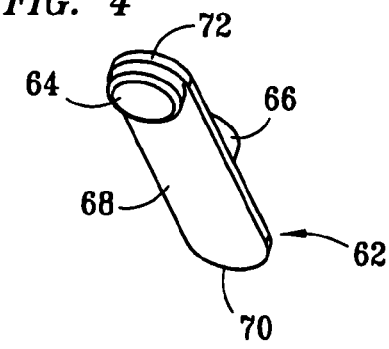

FIG. 4 is a perspective view of the reversing lever 62 of the push-pull handle 24. The reversing lever 62 has an elongate body 68 and the two spaced apart tabs 64 and 66. The two tabs 64 and 66 preferably extend from opposite sides of the elongate body 68, spaced apart longitudinal distances along the length of the elongate body 68. The elongate body 68 of the reversing lever 62 further includes two opposite ends 70 and 72. The tab 66 pivotally secures the reversing lever 62 to the chassis member 14, extending within the lever mounting aperture 74 in the web portion 44 of the chassis member 14. Tab 66 may is preferably pressed to permanently enlarge the outward end of the tab 66 to stake the reversing lever 62 to the chassis member 14, pivotally secured within the aperture 74. The tab 64 is slidably disposed within the oblong-shaped aperture 60. The end of the tab 64 may optionally be pressed to permanently enlarge the outward end of the tab 64 to stake the reversing lever 62 in the aperture 60. In some embodiments, the reversing lever may be formed of plastic, and the tabs 64 and 66 may be heat staked.

FIG. 3A shows the outward end of the front release 22, having slot 78 and an aperture 82. The slot 78 is sized for slidably receiving a shank of a fastener 80, which slidably secures the front release to the web portion 44 of the chassis member 14. The fastener 80 is preferably a rivet secured in one of the apertures 86. The aperture 82 is preferably of a size for receiving the reversing lever 62, in both a transverse direction and a longitudinal direction relative to the longitudinal axis 36 of the drawer slide 12. The aperture has an outward edge 84, for engaging with the ends 70 and 72 of the reversing lever 62. (Shown in FIG. 4). In the preferred embodiment, the aperture 82 is continuous with the slot 78.

Figure 5:
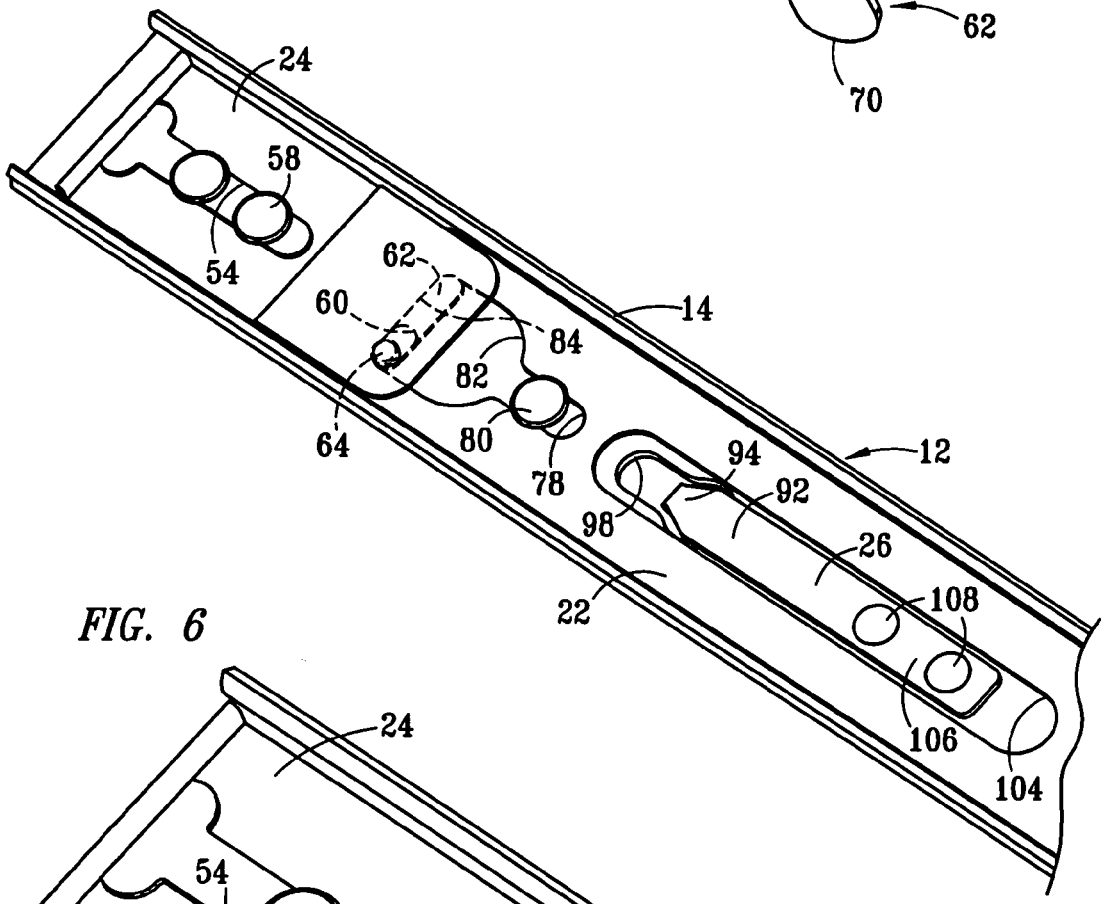

FIG. 5 is a partial perspective view of the push-pull handle 24 of the front release 22, shown in a neutral position. With the push-pull handle 24 in the neutral position, the front release 22 will also be disposed in a neutral position and the front lock 20 will secure the chassis member 14 in an extended position relative to the intermediate member 16. The fasteners 58 are shown disposed in intermediate positions within the slot 54 and fastener 80 is disposed in an intermediate position within the slot 78. The reversing lever 62 is disposed in a position extending across the aperture 82, transverse to the longitudinal axis 36 of the drawer slide 12. The tab 64 is located in the left side of the aperture 60, as viewed in FIG. 5.

Figure 6:
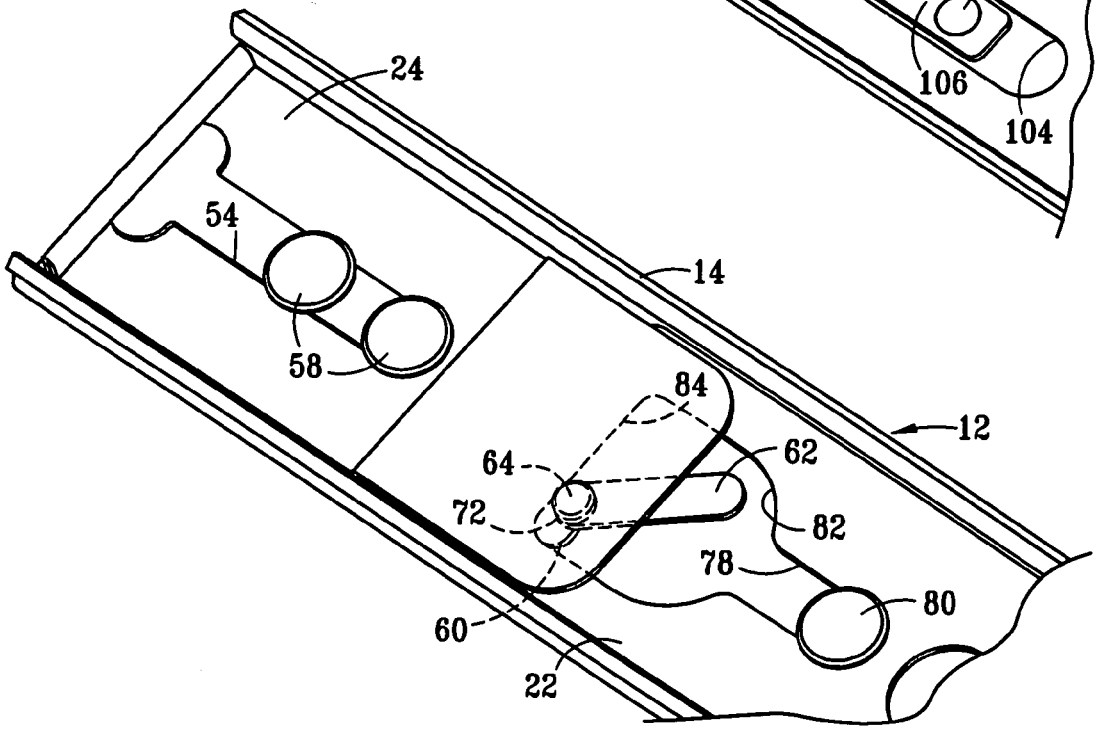

FIG. 6 is a partial perspective view of the push-pull handle 24 of the front release 22, shown after being moved to an outward position relative to the chassis member 14. When the push-pull handle 24 is disposed in the outward position, the front release 22 is disposed in an outward position relative to the chassis member 14, such that the front release 22 has moved away from the front lock 20 and the front lock 20 is released from securing the chassis member 14 in an extended position relative to the intermediate member 16. The fasteners 58 are disposed in an inward end of the slot 54 and fastener 80 is disposed in an inward end of the slot 78. The reversing lever 62 has been pivotally moved within the aperture 82 clockwise, as shown in FIG. 6, such that the end 72 of the reversing lever 62 is pressing against the outward edge 84 of the aperture 82 to pull the front release outward relative to the chassis member 14 and away from the front lock 20. The tab 64 is located in the right side of the aperture 60, as viewed in FIG. 6.

Figure 7:
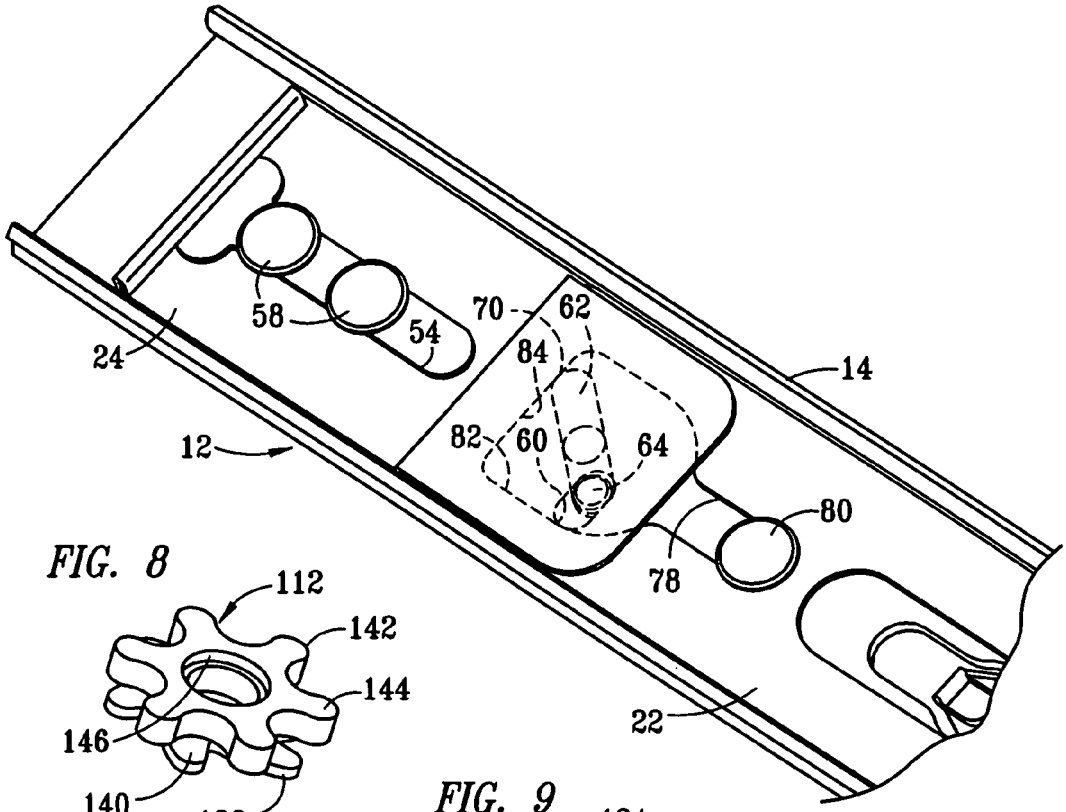

FIG. 7 is a partial perspective view of the push-pull handle 24 of the front release 22, shown after being moved to an inward position relative to the chassis member 14. With the push-pull handle 24 in the inward position, the front release 22 will be again be disposed in an outward position relative to the chassis member 14, such that the front release 22 is moved away from the front lock 20 and the front lock 20 will not secure the chassis member 14 in an extended position relative to the intermediate member 16. The fasteners 58 are now disposed in outward end of the slot 54, yet the fastener 80 is again disposed in an inward end of the slot 78. The reversing lever 62 had been pivotally moved within the aperture 82 in a counter-clockwise direction, as viewed in FIG. 7, such that the end 70 of the reversing lever 62 is pressing against the outward edge 84 of the aperture 82 to pull the front release outward relative to the chassis member 14 and away from the front lock 20. The tab 64 is again located in the right side of the aperture 60, as viewed in FIG. 6.

The latch 26 is provided by an elongate body 92 having an outward end portion 94 with a tab 96. Chassis mounting holes 98 are provided in the chassis member 14, preferably by key-hole shaped slots which each include a narrow portion 100 and an enlarged portion 102. The mounting holes 98 are provided for receiving lugs of a chassis (not shown), such as a drawer or tray, which is mounted to the drawer slide 12 in a conventional mounting arrangement. As is well known in the art, the chassis lugs typically have a head and a shank which extend outward from the side of a chassis in alignment for inserting a respective one of mounting holes 98. The heads of the chassis lugs are wider than the narrow portions 100 of the mounting holes 98 and smaller than the enlarged portions 102 for fitting the heads through the enlarged portions 102 and sliding the shanks of the lugs forward in the narrow portions to mount a chassis to the chassis member 12. The latch 26 is preferably provided for securing one of the chassis lugs in a forward position in the narrow portion 100 of one of the mounting holes 98 to secure the chassis to the chassis member 12 until the latch 26 is released. A slot 104 extends in the front release 22 for receiving the latch 26, and allow adequate clearance for sliding of the front release 22 to operate the front lock 20. An inward end 106 of the latch 26 is secured to the web portion 44 of the intermediate member 14 by fasteners 108, which are preferably provided by two rivets.

FIG. 3B shows the front lock 20, which comprises a ratchet gear 112 and a pawl member 114. The pawl member 114 has an end tip 116 which provides a pawl tip for engaging within the notches defining cogs of the ratchet gear 112. In the preferred embodiment, the pawl member 114 and the pawl tip 116 are provided by the inward end of the front release 22. Movement of the front release 22 in an outward direction will remove the pawl tip 116 from the ratchet gear 112. A fastener 118 rotatably secures the ratchet gear 112 to the web portion 44 of the chassis member 14, fitting within the aperture 120. The fastener 118 is preferably provided by a rivet. A bias spring 122 provides a bias member, or a bias means, for urging the pawl tip 116 into the ratchet gear 112. A guide track 124 is defined by two spaced apart guide members 126 and 128 defined by two embosses into the web portion 44 of the chassis member 14. The two embosses defining the guide members 126 and 128 preferably have flat surfaces for engaging opposite edges of the front release 22, and locating the front release 22 for the pawl tip 116 to correctly engage the ratchet gear 112. Two front lock stops 130 and 132 are provided by two protuberances which extend from a web portion 42 of the forward end of the intermediate member 16. The two protuberances defining the stops 130 and 132 are spaced apart along the longitudinal axis 36, on opposite sides of the longitudinal axis 36. The spacing between the stops 130 and 132, and a pitch of the cogs for the ratchet gear 112, are preferably selected such that the two stops 130 and 132 will simultaneously fit within two different notches defining cogs of the ratchet gear 112, with the pawl tip 116 engaged in one of the notches of the ratchet gear 112, to minimize backlash.

Figure 8:
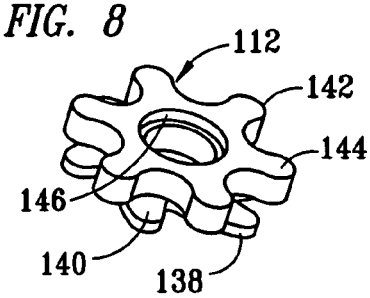
Figure 9:
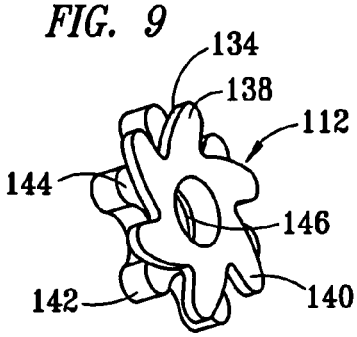

FIGS. 8 and 9 are partial perspective views of opposite sides of the ratchet gear 112. The ratchet gear 112 is preferably provided by two gears which are formed of a single member, which comprises a first gear 138 and a second gear 142. The first gear 138 has ratchet cogs 140 which are engaged by the end tip 116 of the pawl member 114. The second gear 142 has lock cogs 144 for engaging the stops 130 and 132. An aperture 146 provides a central bore through the ratchet gear 112, and around which the first gear 138 and the second gear 142 are concentrically formed.

Figure 10:
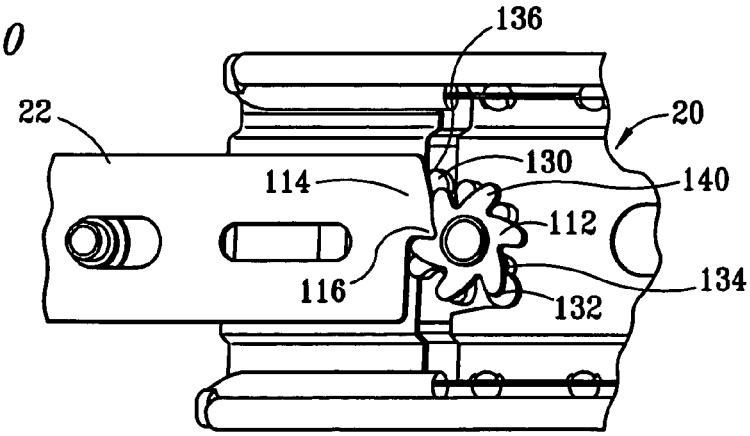

FIG. 10 is a partial perspective view of the front lock 20 securing the chassis member 14 in an extended position relative to the intermediate member 16. The protuberances providing the stops 130 and 132 are engaged in spaced apart notches defining the lock cogs 144 of the second gear 142, and the pawl tip 116 of the pawl member 114 is engaged within one of the notches defining the ratchet cogs 140 of the first gear 138 of the ratchet gear 112. The ratchet cogs 140 are curved in a angular direction around a central axis of the ratchet gear 112 to define cam surfaces 134 for engaging a cam surface 136 of the pawl member 114, such that rotation of the ratchet gear 112 in a first direction will push the pawl member 114 away from the ratchet gear 112 and allow the ratchet gear 112 to rotate and index to the next angular position. The lock cogs 144 of the second gear 142 of the ratchet gear 112 are symmetrical on both sides of the lock cogs 144, such that when the pawl member 114 is engaging the ratchet cogs 140, the two spaced apart stops 130 and 132 will prevent rotation of the ratchet gear 112.

Figure 11:
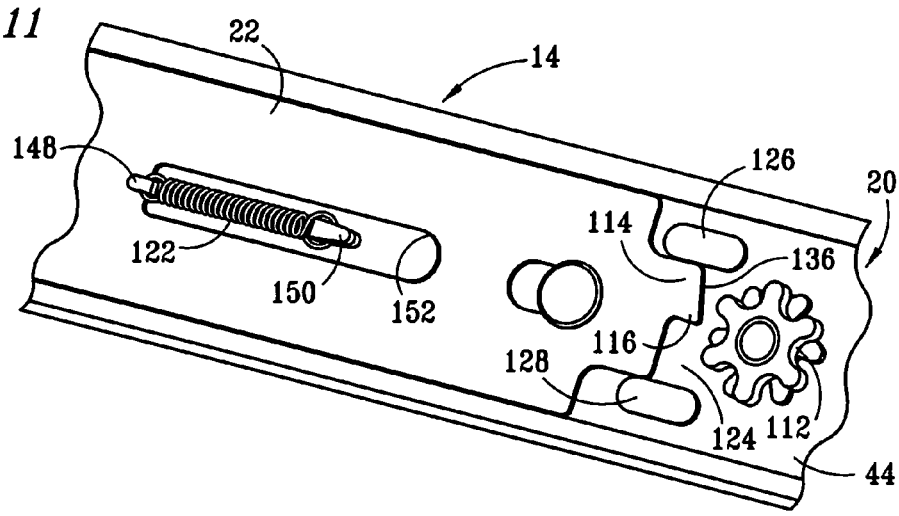

FIG. 11 is a partial perspective view of the front lock 20 after being released from securing the chassis member 14 in an extended position relative to the intermediate member 16. The front release 22 has been moved outward from the ratchet gear 112, removing the pawl tip 116 from one of the notches defining the ratchet cogs 140 and allowing the ratchet gear 112 to rotate relative to the stops 130 and 132, such that the chassis member 14 may be moved relative to the intermediate member 16.

Figure 12:
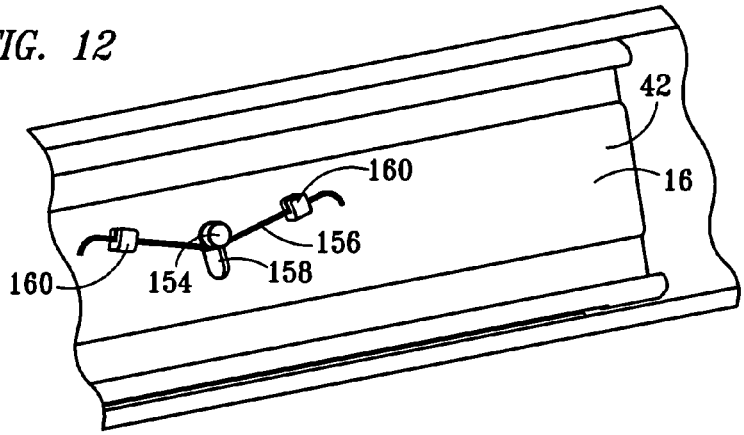

FIG. 12 is partial perspective view of a first side of a lock pin 154 and a torsion spring 156 providing the rear lock 28 of the drawer slide 12. The rear lock 28 releasibly secures the intermediate member 16 in an extended position relative to the cabinet member 18. A slot 158 extends in the web portion 42 of the intermediate member 16. The lock pin 154 is slidably secured within the slot 158 for moving transverse to the longitudinal axis 36 of the drawer slide 12. The torsion spring 156 is secured to the intermediate member 16 by fastening members 160, which are preferably tabs which are lance formed into the web portion 42 of the intermediate member 16.

Figure 13:
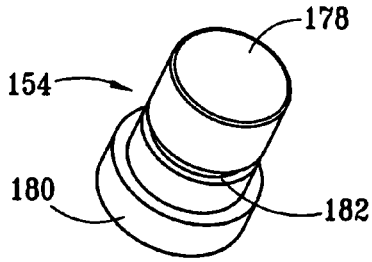
Figure 14:
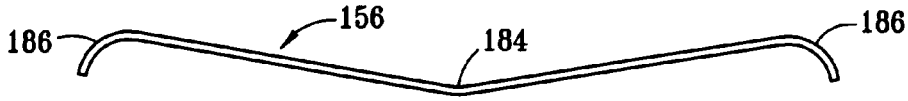

FIG. 13 is a perspective view of the lock pin 154 of the rear lock 28. FIG. 14 is a perspective view of the torsion spring 156. The lock pin 154 has a shank 178 and a head 180. A circumferentially extending, annular-shaped groove 182 is formed into the shank 178 to define an aperture or notch in the shank 178 for receiving the torsion spring 156. The torsion spring 156 is preferably formed with a bend in a central portion thereof, and two ends 186. In other embodiments, an aperture may extend as a bore hole through the shank 178 of the pin 154.

Figure 3C:
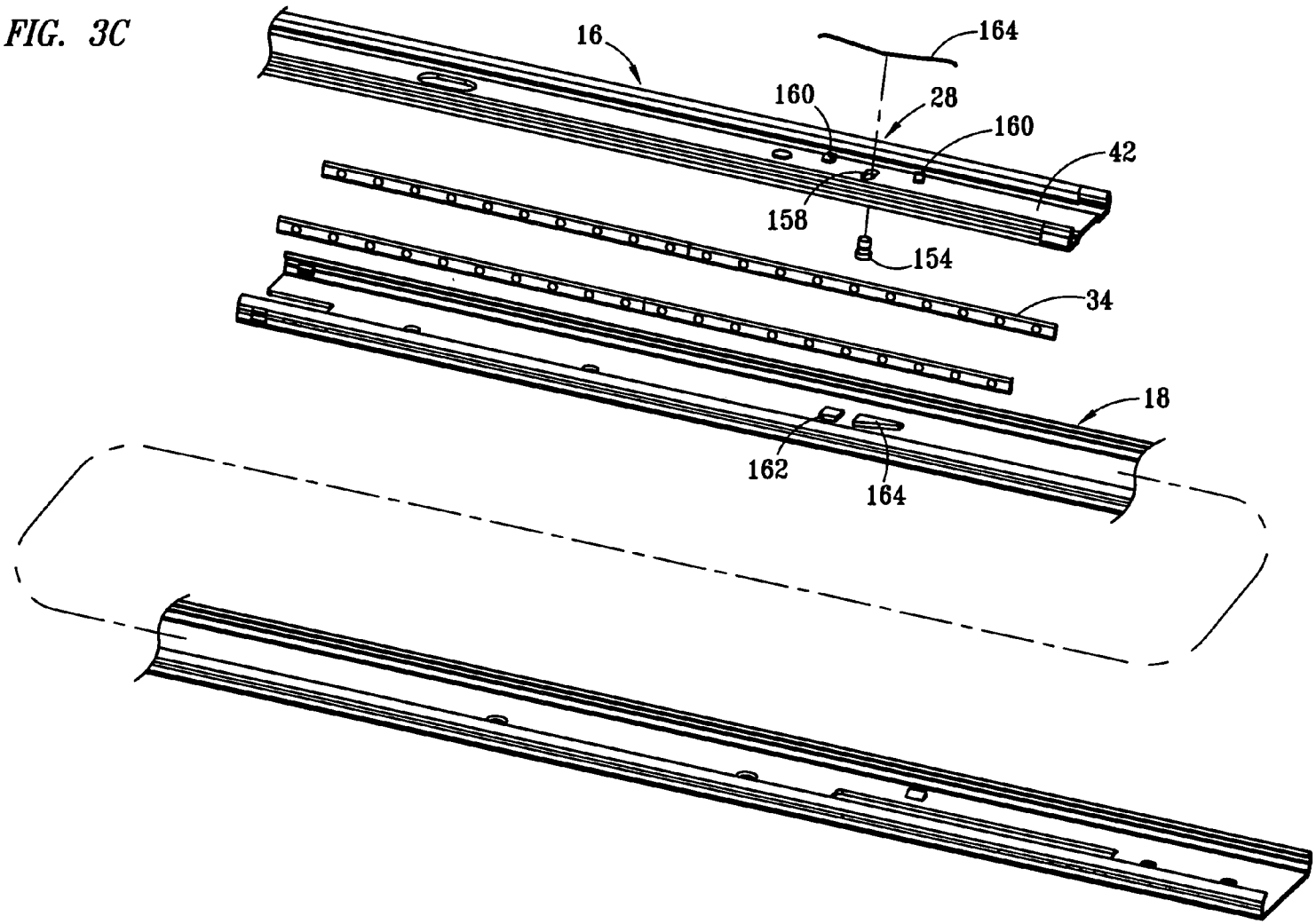
FIG. 3C is a partial, exploded view of a rearward portion of the drawer slide.
Figure 15:
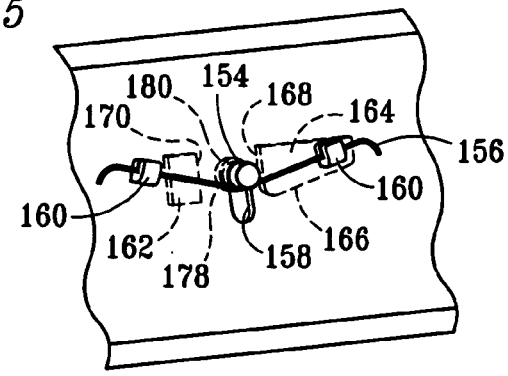

FIG. 15 is a side elevation view of a the rear lock 28. A forward stop 162 and a rearward stop 164 are shown a hidden lines, disposed on the opposite side of the intermediate slide member 16 from the torsion spring 156 and the fastening members 160. The forward stop 162 and the rearward stop 164 are provided by embosses formed into the web portion 188 of the cabinet member 18. (Shown in FIG. 3C). The rearward stop 164 has a cam surface 166 and a stop surface 168 for preventing rearward movement of the pin 154. The forward stop 162 has a cam stop surface 162. The head 180 of the lock pin 154 is trapped between the forward stop 162 and the rearward stop 164, until the release member 172 (shown in FIG. 16) is moved rearward to engage the shank 178 of the pin 154. Movement of the release member 172 against the shank 178 of the lock pin 154 will move the head 180 of the pin 154 from between the forward stop 162 and the rearward stop 164.

Figure 16:
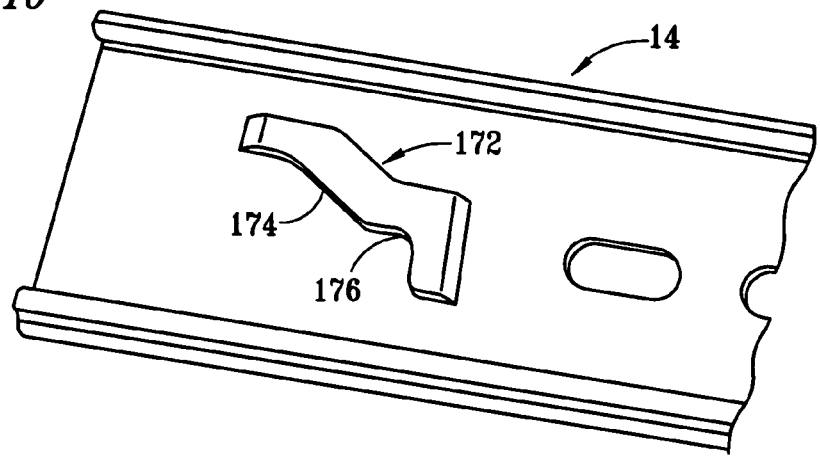

FIG. 16 is a partial perspective view of a release member 172 provided by an emboss formed into the web portion 44 of the chassis member 14. The release member 172 includes a cam surface 174 and a stop surface 176. The cam surface 174 will engage the shank 178 of the lock pin 154 to move the pin 154 into the stop surface 176 when the chassis member 14 is moved rearward into the intermediate member 16.

Figure 17:
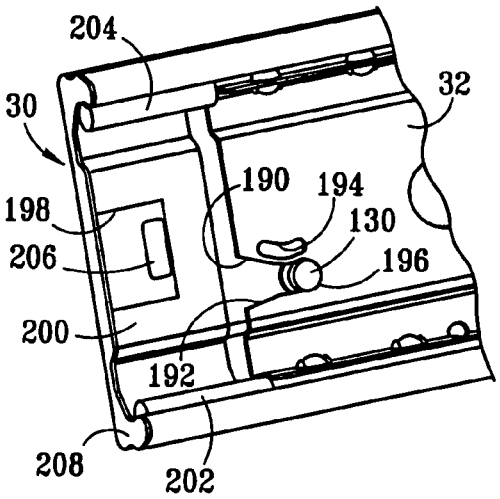

FIG. 17 is partial section view of an outward end of then intermediate member 16 of the drawer slide 12, showing a bearing retainer 32 and the guide bushing 30 disposed within the outward end of the intermediate member 16. A slot 190 is formed into the outward, terminal end of the bearing retainer 32. The slot 190 has a tapered entrance, adjacent to which is an aperture 194. The aperture 194 is disposed a selected distance from the edge of the slot 190 to provide a resilient edge of the slot 190 for flexing to receive the stop tab 130 into a narrow end 196 of the slot 190. A slight press fit is provided such that the stop tab 130 will engage within the slot 190 to hold the bearing retainer in the forward end of the intermediate member 16 for receiving the chassis member 14, when the chassis member 14 is removed from within the intermediate member 16. Once the chassis member 14 is inserted within the bearing retainer 32, the bearing retainer 32 will be pushed rearward with sufficient force to remove the stop 130 from within the slot 190. The slot 194 is disposed the selected distance from the edge of the slot 190 to determine the force at which the stop 130 will be removed from within the slot 190.

The guide bushing 30 is provided to both aid in guiding the chassis member 14 into the intermediate member 16, and to secure the bearing retainer 32 within the intermediate member 16. The guide bushing 30 has a web portion with an aperture 198 extending rearward from a forward end of the guide bushing 30. Two edge members 202 and 204 are preferably cylindrical for fitting within respective ones of the bearing races of the edges of the intermediate member 16, and for fitting against the bearing races of the edges of the chassis member 14. A latch tab 206 is provided for fitting within the aperture 198 to secure the guide bushing 30 to the forward end of the intermediate member 16. An end tab 208 provides a stop for preventing insertion of the guide bushing into the intermediate member 16 beyond the forward edge of the intermediate member 16.

Figure 18:
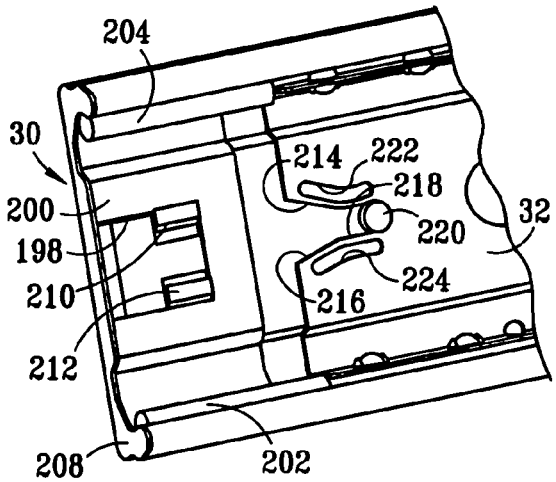

FIG. 18 is partial section view of an outward end of an alternative embodiment of an intermediate member 16 of the drawer slide 12, showing an alternative bearing retainer fastening means provided by two tabs 210 and 212. The two tabs fit within the aperture 198 to secure the guide bushing 30 within the forward end of the intermediate member 16. An alternative stop tab 220 is also provided for fitting within a slot 214 formed into the forward end of the bearing retainer 32. The slot 214 has a tapered portion 216 and a narrow portion 218. Two slots 222 and 224 are cut into the web portion of the end of the bearing retainer 32 a selected distance from the edge of the slot 216 to determine the force required to remove the stop tab 220 from within the slot 124, such that the bearing retainer 32 will remain disposed in the forward end of the intermediate member 16 adjacent to the guide bushing 30 for insertion of the chassis member 14 into the intermediate member 16 and the guide bushing 32, until the predetermined force is exceeded.

Figure 19:
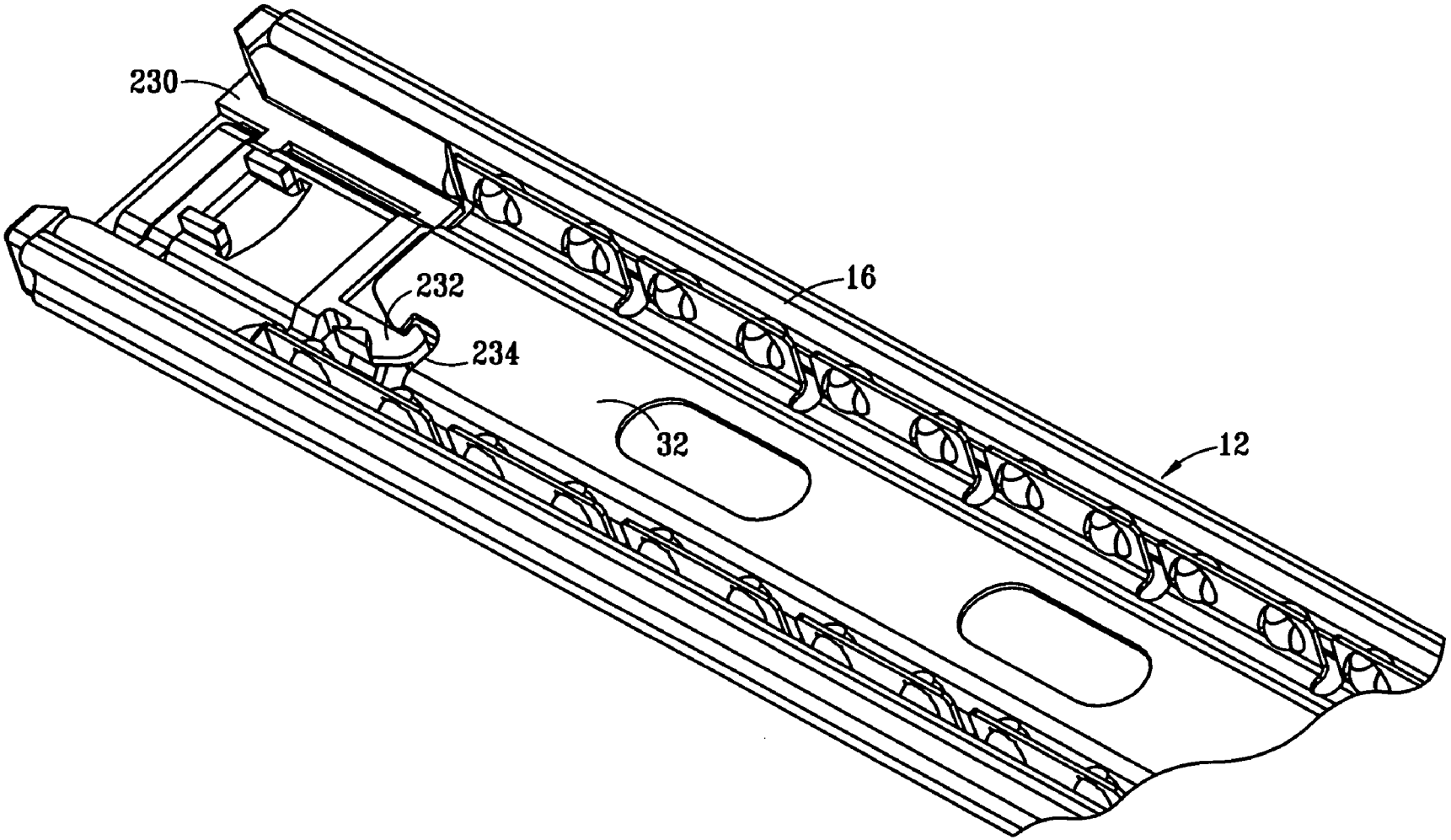

FIG. 19 is a partial section view of an outward end of the intermediate member 16 of the drawer slide 12, having a guide bushing 230 which includes a bearing retainer lock arm 232 according to a preferred embodiment of the drawer slide 12. The lock arm 232 engages a notch defined by a J-shaped slot, J-slot 234, formed into the forward end of a web portion of the bearing retainer 32 to releasibly secure the bearing retainer 32 in a forward end of the intermediate member 16. A release member 236 (shown in FIG. 21) will release the lock arm 232 from the J-slot 234 when the chassis member 14 is inserted into the intermediate member 14 and the bearing retainer 32. The lock arm 232 will also preferably release from the J-slot 234 of the bearing retainer 32 when a preselected force is exceeded, to release the bearing retainer 32 from the forward end of the intermediate member 16.

Figure 20:
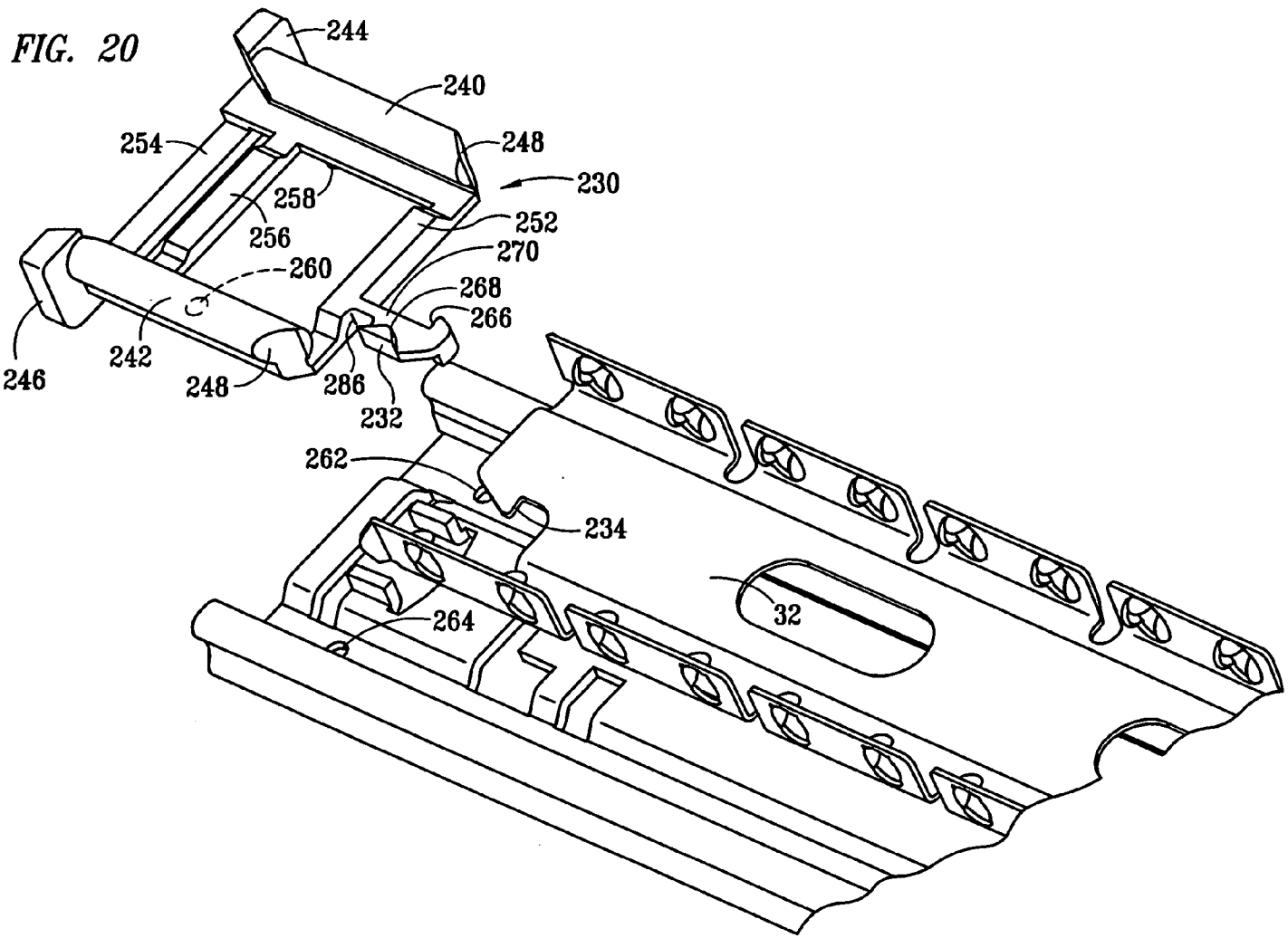
Figure 21:
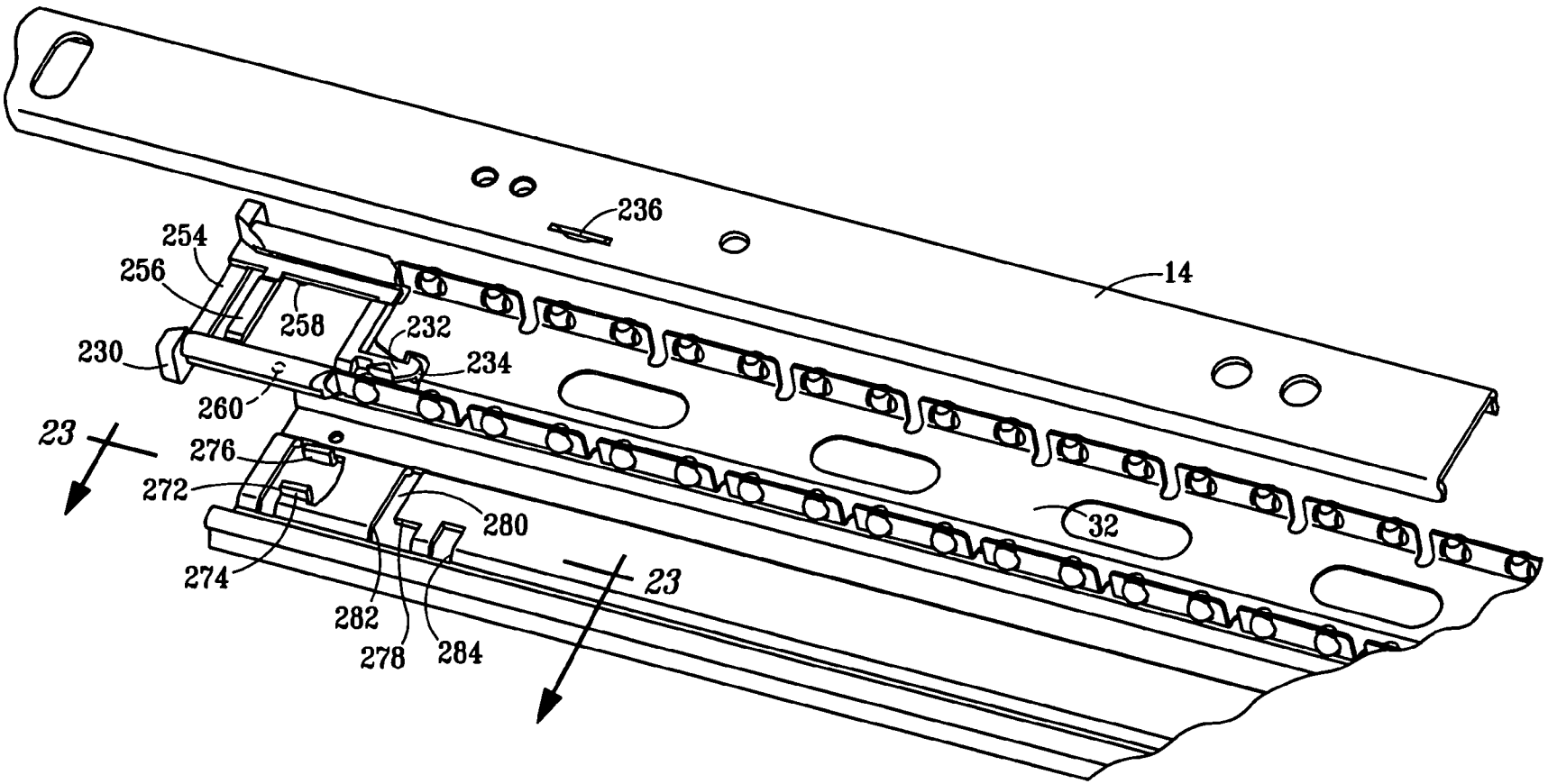

FIGS. 20 and 21 are partial exploded views of the intermediate member 16 having the guide bushing 230. The guide bushing 230 has edge members 240 and 242 on opposite sides of the guide bushing 230. The edge members 240 and 242 are preferably of a shape for engaging within the bearing races defined by the edges of the intermediate member 16 and engaging the bearing races defined by the edges of the chassis member 14. Stops 244 and 246 are provided on the outward ends of the edge members 240 and 242, respectively, to prevent insertion of the outer end of the guide bushing 230 into the intermediate member 16. The inward ends of the edge members 240 and 242 have chamfers 248 and 250 for overlapping the ends guide bushing 230 with of end of the bearing retainer 32 to prevent the chassis member 14 from prying the lock arm 232 of the guide bushing 230 out of engagement with bearing retainer 32 during insertion of the chassis member 14. The guide bushing 230 has cross-members 252, 254 and 256 which are spaced apart and extend between the edge members 240 and 242. Two tabs 258 and 260 extend from respective sides of the edge members 240 and 242 for inserting into apertures 262 and 264, and then heat staking the outward ends of the tabs 258 and 260 to prevent removal from the apertures 262 and 264. A lock tab 266 is provided on the terminal end of the lock arm 232. A cam surface 268 is provided in an intermediate portion of the lock arm 232. A notch 286 is provided in a first portion 270 of the lock arm 232.

Figure 22:
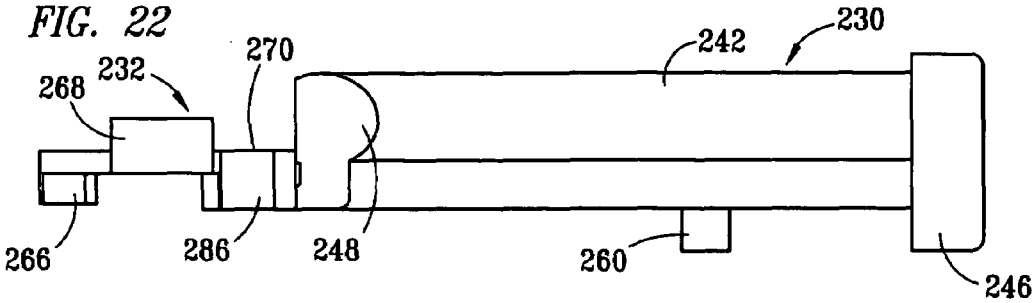

FIG. 22 is a top view of the guide bushing 230 having the bearing retainer lock arm 232. The stop end 246 and the end chamfer 248 is shown for the edge member 242. The tab 260 for heat staking in the aperture 264 of the intermediate member is shown extending from the edge member 242. The lock arm 232 is shown with the first portion 270 which has a notch 286 formed therein. The notch 286 is sized to allow the lock arm 232 to flex in response to a predetermined force, to release the bearing retainer 32 should the predetermined force be exceeded prior to the release member 236 engaging the cam surface 268. The lock tab 266 is shown disposed on a rearward end of the lock arm 232.

Figure 23:
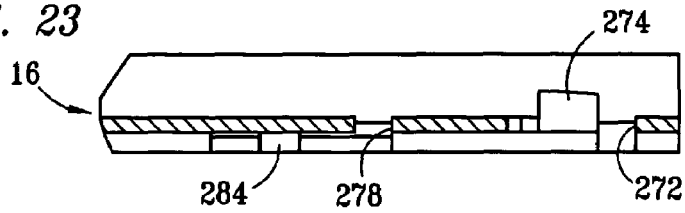

FIG. 23 is sectional view of the intermediate member of FIG. 21, taken along Section Line 23-23. The forward end of the intermediate member 16 is formed for securing the portions of the guide bushing 230 thereto. The cross-member 254 abuts the forward terminal end of the web portion 42 of the intermediate member 16. A slot 272 is formed into the web portion 42 of the intermediate member 16 for receiving the cross-member 256 of the guide bushing 230. Two lock tabs 272 and 274 are formed to extend upward from the web portion 42 for securing against an inward side of the cross-member 256. A slot 278 extends transversely across the web portion 42 for receiving the cross-member 252 and a first portion 270 of the lock arm 232. The slot 278 includes a narrow portion 280 and an enlarged portion 282. The narrow portion 280 receives the cross-member 252 and the enlarged portion 282 receives the first portion 270 of the lock arm 232. The aperture 284 provides a window in the web portion 42 for receiving the lock tab 166 of the lock arm 232.

Figure 24:
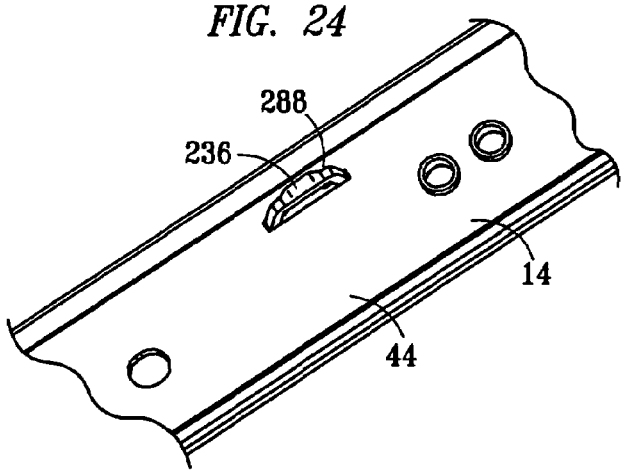

FIG. 24 is a perspective view of a portion of the chassis member 14 having a release member 236 provided by an emboss formed into the web portion 44. The release member 236 has a cam surface 288 for engaging the cam surface 268 (shown in FIG. 20) of the lock arm 232. The release member 236 is preferably formed into an the chassis member 14 at a distance from the rearward end of the chassis member 14 for releasing the bearing retainer lock 232 after the chassis member 14 has been sufficiently inserted a selected distance within the intermediate member 16 and the guide bushing 32.

Figure 25:
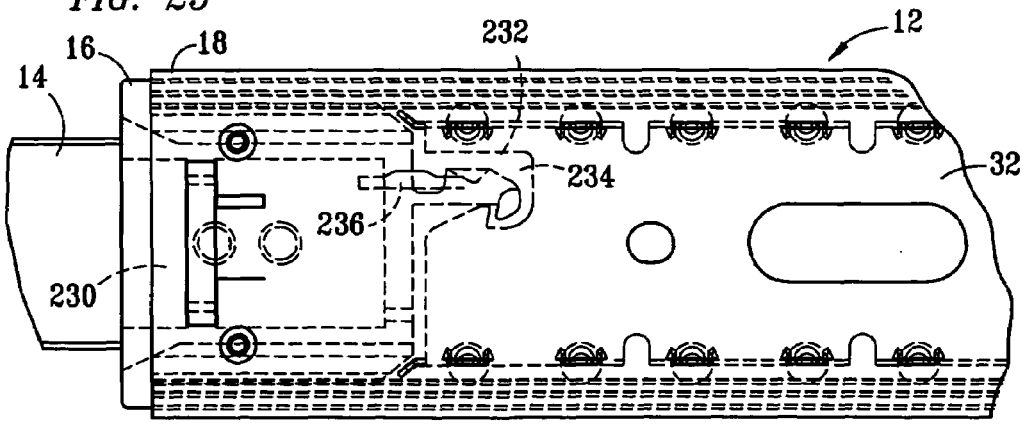

FIG. 25 is a partial side elevation view of the drawer slide 12, showing operation of the guide bushing 230. The chassis member 14 is shown inserted within the intermediate member 16 and the bearing retainer 32. The release member 236 is engaging the lock arm 232 to remove the lock arm for engaging within the J-slot 234 of the outward end of the bearing retainer 32.

Preferably, the guide bushing 30 and the guide bushing 230 are formed of plastic. The chassis member 14, the intermediate member 16, the cabinet member 18 and the bearing retainers 32 and 34 are preferably formed of metal. The ratchet gear 112 and the lock pin 154 are also preferably formed of metal. The chassis latch 26, the bias spring 122 and the torsion spring 156 are preferably formed of spring steel. The above-noted components may also be formed of other suitable materials. It should also be noted, that although the term chassis member, intermediate member and cabinet member are used herein, the features of the present invention may be used in other configurations and drawer slide applications. Additionally, rotating sleeves or bushings maybe disposed on shanks of the fasteners used herein to provide bearings for moveable slide members.

The drawer slide of the present invention includes features of a push-pull release for a front release for a front lock, a gear and pawl lock for use with a front release, a rear lock provided by a pin with torsion spring, and a guide bushing with bearing retainer lock. The above-noted features may be selectively used in combination, or each may separately be used on different drawer slides. The above-noted features, other than the bearing retainer lock, may also be used with friction type drawer slides.

Although the preferred embodiment has been described in detail, it should be understood that various changes, substitutions and alterations can be made therein without departing from the spirit and scope of the invention as defined by the appended claims.

What is claimed is:

1. A drawer slide having first and second slide members slidably secured together in a telescopic arrangement, said drawer slide comprising:

a slot formed into a web portion of the first slide member;

a pin moveably secured within said slot of the first slide member, said pin being lineally moveable between first and second positions within said slot;

a bias member mounted to the first slide member, such that said bias member urges said pin into said first position within said slot;

said pin extending outward of said slot in the first slide member and toward the second slide member, wherein said pin has a head and a shank extending from said head, said head disposed on one side of said first slide member and being larger than a width of said slot for retaining said pin from passing through said slot, and said shank extending through said slot and having a notch disposed on an opposite side of said first slide member from said head, wherein said notch receives said bias member for preventing said shank from moving outward of said slot;

a stop disposed on the second slide member, aligned for engaging said pin when said pin is disposed in said first position within said slot and the first slide member is disposed in a first relative position in relation to the second slide member, and said stop aligned for being disposed aside of said pin when said pin is disposed in said second position within said slot; and a release member disposed in relation to the first slide member, such that said release member is moveable relative to the first slide member to engage said pin and move said pin to said second position within said slot, in which said pin is disposed aside of said stop for moving the first slide member relative to the second slide member.

2. The drawer slide according to claim 1, wherein said bias member is a torsion spring, which extends between two tabs formed into a web portion of the first slide member.

3. The drawer slide according to claim 1, wherein said stop is defined by an emboss formed into a web of the second slide member.

4. The drawer slide according to claim 1, wherein said slot extends transverse to said longitudinal axis of said drawer slide, such that said first and second positions in which said pin is disposed in said slot are separated in a direction which is transverse to said longitudinal axis.

5. The drawer slide according to claim 1, further comprising a second stop disposed on the second slide member, wherein said second stop is spaced apart from the first stop and aligned for engaging said pin when said pin is disposed in said first position within said slot and the first slide member is disposed in a first relative position in relation to the second slide member, and said second stop is aligned for being disposed aside of said pin when said pin is disposed in said second position within said slot.

6. The drawer slide according to claim 1, further comprising a third slide member which is slidably extensible relative to the first and second slide members, wherein said release member is disposed on the third slide member.

7. The drawer slide according to claim 6, wherein said release member is an emboss formed into the third slide member.

8. The drawer slide according to claim 1, wherein said slot extends transverse to said longitudinal axis of said drawer slide, such that said first and second positions in which said pin is disposed in said slot are separated in a direction which is transverse to said longitudinal axis; and said bias member is a torsion spring, which extends between two tabs formed into a web portion of the first slide member and urges said pin to move in said direction, transverse to said longitudinal axis.

9. The drawer slide according to claim 1, wherein said shank has an annular shaped portion, said bias member is mounted to the first slide member on an opposite side of the first slide member from the second slide member, and said head fully extends between web portions of the first slide member and the second slide member such that said head and said bias member are fully disposed on opposite sides of the web portion of the first slide member.

10. A drawer slide having first, second and third slide members which are slidably secured together in a telescopic arrangement for slidably extending along a longitudinal axis of said drawer slide, said drawer slide comprising:

a slot formed into a web portion of the first slide member, extending transverse to said longitudinal axis of said drawer slide, to define first and second positions in said slot which are separated in a direction which is transverse to said longitudinal axis;

a pin moveably secured within said slot of the first slide member, said pin being moveable along an edge of said slot between said first position and said second position within said slot;

bias means mounted to the first slide member, such that said bias means urges said pin into said first position within said slot;

said pin extending from said slot in the first slide member and toward the second slide member, wherein said pin has a head and a shank extending from said head, said head disposed on one side of said first slide member and being larger than a width of said slot for retaining said pin from passing through said slot, and said shank extending through said slot and having a notch disposed on an opposite side of said first slide member from said head, wherein said notch receives said bias means for preventing said shank from moving outward of said slot;

a stop disposed on the second slide member, aligned for engaging said pin when said pin is disposed in said first position within said slot and the first slide member is disposed in a first relative position in relation to the second slide member, and said stop aligned for being disposed aside of said pin when said pin is disposed in said second position within said slot; and a release member extending from the third slide member, and being moveable with the third slide member relative to the first slide member to engage said pin and move said pin to said second position within said slot, in which said pin is disposed aside of said stop for moving the first slide member relative to the second slide member.

11. The drawer slide according to claim 10, wherein said bias means is a torsion spring, which extends between two tabs formed into a web portion of the first slide member.

12. The drawer slide according to claim 10, wherein said stop defined by an emboss formed into a web of the second slide member.

13. The drawer slide according to claim 10, wherein said release member is an emboss formed into the third slide member.

14. The drawer slide according to claim 10, further comprising a second stop disposed on the second slide member, wherein said second stop is spaced apart from the first stop and aligned for engaging said pin when said pin is disposed in said first position within said slot and the first slide member is disposed in a first relative position in relation to second slide member, and said second stop is aligned for being disposed aside of said pin when said pin is disposed in said second position within said slot.

15. The drawer slide according to claim 10, wherein said shank has an annular shaped portion into which said notch is formed, said bias means is mounted to the first slide member on an opposite side of the first slide member from the second slide member and extends into said notch, and said head fully extends between web portions of the first slide member and the second slide member such that said head and said bias member are fully disposed on opposite sides of the web portion of the first slide member.

16. A drawer slide having first, second and third slide members slidably secured together in a telescopic arrangement for slidably extending along a longitudinal axis of said drawer slide, said drawer slide comprising:

a slot formed into the web portion of the first slide member, extending transverse to said longitudinal axis of said drawer slide, to define first and second positions in said slot which are separated in a direction which is transverse to said longitudinal axis;

a pin having a head and a shank, said shank having a notch formed therein, and wherein said head is larger than a width of said slot and said shank fits within said slot such that said shank of said pin is adapted for moving in said slot between said first position and said second position;

a torsion spring extending between two fastening members securing said torsion spring to said web portion of the first slide member and engaging within said notch in said shank of said pin to urge said pin into a first position within said slot;

said head of said pin extending on an opposite side of the first slide member from said torsion spring, and said notch in said shank aligned for disposing on an opposite side of said first slide member from said head and receiving said torsion spring to retain said pin within said slot wherein said torsion spring and said pin are self-retained on said first slide member;

a first stop disposed on the second slide member, said first stop aligned for engaging said head of said pin as the first slide member is extended from slide member; and a release member disposed on the third slide member, said release member being moveable with the third slide member for engaging said shank of said pin and moving said pin to a second position within said slot, in which said head of said pin is disposed aside of said first stop for moving the first slide member relative to the second slide member.

17. The drawer slide according to claim 16, further comprising a second stop disposed on the second slide member, wherein said second stop is spaced apart from said first stop and aligned for engaging said pin when said pin is disposed in said first position within said slot and the first slide member is disposed in a first relative position in relation to the second slide member, and said second stop is aligned for being disposed aside of said pin when said pin is disposed in said second position within said slot.

18. The drawer slide according to claim 17, wherein said first and second stops are defined by embosses formed into a web of the second slide member.

19. The drawer slide according to claim 18, wherein said release member is an emboss formed into the third slide member.

20. The drawer slide according to claim 16, wherein said notch defines an annular shaped groove formed into said shank of said pin for receiving said torsion spring, and said torsion spring retains said pin from moving fully out of said slot in a direction toward the second slide member and said head retains said pin from moving fully out of said slot in a direction away from the second slide member.

* * * * *